US008115412B2

(12) United States Patent
Urakabe et al.

(10) Patent No.: US 8,115,412 B2
(45) Date of Patent: Feb. 14, 2012

(54) DRIVE DEVICE FOR LIGHT-EMITTING ELEMENT

(75) Inventors: Takahiro Urakabe, Tokyo (JP); Takahiko Yamamuro, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 424 days.

(21) Appl. No.: 12/488,988

(22) Filed: Jun. 22, 2009

(65) Prior Publication Data

US 2010/0007290 A1 Jan. 14, 2010

(30) Foreign Application Priority Data

Jul. 8, 2008 (JP) ..... 2008-178257

(51) Int. Cl.

| | |
|---|---|
| ***G05F 1/00*** | (2006.01) |
| ***H05B 37/02*** | (2006.01) |
| ***H05B 41/04*** | (2006.01) |
| ***H05B 41/36*** | (2006.01) |

(52) U.S. Cl. ..... 315/294; 315/291; 315/307; 315/308

(58) Field of Classification Search ..... 315/185 S, 315/185 R, 224–226, 246–247, 291, 294, 315/302, 307–308, 312, 324; 345/82, 204, 345/212–214

See application file for complete search history.

(56) References Cited

U.S. PATENT DOCUMENTS

| | | | | |
|---|---|---|---|---|
| 8,035,315 | B2 * | 10/2011 | Zhao et al. | 315/299 |
| 2003/0025465 | A1 * | 2/2003 | Swanson et al. | 315/291 |
| 2008/0094008 | A1 * | 4/2008 | Liu | 315/294 |

FOREIGN PATENT DOCUMENTS

JP 2007-273666 10/2007

* cited by examiner

*Primary Examiner* — Anh Tran

(74) *Attorney, Agent, or Firm* — Oblon, Spivak, McClelland, Maier & Neustadt, L.L.P.

(57) ABSTRACT

A power converting unit supplies a predetermined current to each of light-emitting elements by controlling a duty ratio of a semiconductor switching element. A light-emitting-element selecting unit sequentially selects a light-emitting element to be supplied with the current from the power converting unit. A duty-ratio control unit controls the duty ratio of the semiconductor switching element based on a value obtained by multiplying a gain by a difference between an output current of the power converting unit and a target current. A gain selecting unit changes the gain according to selected light-emitting element.

7 Claims, 7 Drawing Sheets

FIG.2

| | LIGHT EMISSION PERIOD OF LD_R | LIGHT EMISSION PERIOD OF LD_B | LIGHT EMISSION PERIOD OF LD_G |
|---|---|---|---|
| MOS_R | ON | OFF | OFF |
| MOS_B | OFF | ON | OFF |
| MOS_G | OFF | OFF | ON |
| Sw_GR | ON | OFF | OFF |
| Sw_GB | OFF | ON | OFF |
| Sw_GG | OFF | OFF | ON |
| I_Order | SET TO TARGET VALUE OF LD_R | SET TO TARGET VALUE OF LD_B | SET TO TARGET VALUE OF LD_G |

FIG.5

| | LIGHT EMISSION PERIOD OF LD_R | LIGHT EMISSION PERIOD OF LD_B | LIGHT EMISSION PERIOD OF LD_G | CURRENT CONTROL PERIOD |
|---|---|---|---|---|
| MOS_R | ON | OFF | OFF | |
| MOS_B | OFF | ON | OFF | |
| MOS_G | OFF | OFF | ON | |
| Sw_GR | ON | OFF | OFF | |
| Sw_GB | OFF | ON | OFF | |
| Sw_GG | OFF | OFF | ON | |
| I_Order | SET TO TARGET VALUE OF LD_R | SET TO TARGET VALUE OF LD_B | SET TO TARGET VALUE OF LD_G | SET TO TARGET VALUE OF LD_R |

DRIVE DEVICE FOR LIGHT-EMITTING ELEMENT

BACKGROUND OF THE INVENTION

1. Field of the Invention

The present invention relates to a technology for driving a plurality of light-emitting elements with different currents for obtaining predetermined emission intensities.

2. Description of the Related Art

There is a display unit that uses a light-emitting element such as a light-emitting diode (LED), as a light source, for emitting each light of red (R), green (G), and blue (B) colors, drives the light-emitting element in a time division manner, and sequentially emits each of the RGB colors, so that a color image can be projected on the screen. To reduce a circuit scale of the display unit, there is a method of sharing a power supply unit with the light-emitting elements for the colors and sequentially applying a power from the power supply unit to each of the light-emitting elements. In this case, because rated currents required for the light-emitting elements for the colors to emit the lights at predetermined luminance are different from each other, the current to be supplied to each of the light-emitting elements also needs to be controlled at each timing for emitting the respective light.

To control the current to be supplied to each of the light-emitting elements, Japanese Patent Application Laid-open No. 2007-273666 discloses a method of variably setting the current by providing a variable setting unit that variably sets the value of the current to a set current corresponding to each of the light-emitting elements and switching between resistors corresponding to the light-emitting elements using a switching element. Japanese Patent Application Laid-open No. 2007-273666 also discloses a method of supplying a required power to a light-emitting element which has an insufficient power immediately after being switched, absorbing a power of a light-emitting element which has an excessive power, and stabilizing the current flowing through each of the light-emitting elements by charging a voltage appropriate for a drive voltage of the light-emitting element in an auxiliary capacitor and connecting the auxiliary capacitor in parallel to the light-emitting element at a predetermined timing.

According to the conventional technology described above, however, because the set current is changed by switching between the resistors corresponding to the light-emitting elements using the switching element, it is difficult to stabilize an output current at a fast response speed corresponding to a change of a status (current and voltage) of the light-emitting element. Moreover, in the above method, a large capacitance is required when a difference in currents upon switching is large, and thus, responsivity to an output current from the power supply unit is degraded, which makes it more difficult to stabilize the output current at a fast response speed, which leads to an increase of the device in size and an increase in cost.

SUMMARY OF THE INVENTION

It is an object of the present invention to at least partially solve the problems in the conventional technology.

According to one aspect of the present invention, there is provided a device for driving at least two light-emitting elements with different currents required for obtaining predetermined emission intensities. The device includes a power converting unit that supplies a predetermined current to each of the light-emitting elements by controlling a duty ratio of a semiconductor switching element that intermittently conducts a direct-current voltage; a light-emitting-element selecting unit that sequentially selects a light-emitting element to be supplied with the current from the power converting unit; a duty-ratio control unit that controls the duty ratio of the semiconductor switching element based on a value obtained by multiplying a gain by a difference between an output current of the power converting unit and a target current; and a gain selecting unit that changes the gain according to selected light-emitting element.

Furthermore, according to another aspect of the present invention, there is provided a device for driving at least two light-emitting elements with different currents required for obtaining predetermined emission intensities. The device includes a power converting unit that supplies a predetermined current to each of the light-emitting elements by controlling a duty ratio of a semiconductor switching element that intermittently conducts a direct-current voltage; a light-emitting-element selecting unit that sequentially selects a light-emitting element to be supplied with the current from the power converting unit; and a current-control-period setting unit that sets a current control period in which a current flowing through the light-emitting element is reduced. When a current supplied to a currently selected light-emitting element is larger than a current to be supplied to a next selected light-emitting element, the current-control-period setting unit sets the current control period for the currently selected light-emitting element before supplying the current to the next selected light-emitting element.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 2 is a diagram of ON/OFF periods of field-effect transistors MOS_R, MOS_B, and MOS_G shown in FIG. 1;

FIG. 5 is a diagram of ON/OFF periods and a current control period of field-effect transistors MOS_R, MOS_B, and MOS_G shown in FIG. 4;

DETAILED DESCRIPTION OF THE PREFERRED EMBODIMENTS

Exemplary embodiments of a drive device for a light-emitting element according to the present invention are explained in detail below with reference to the accompanying drawings. It is noted that the present invention is not limited to the embodiments.

Figure 1:
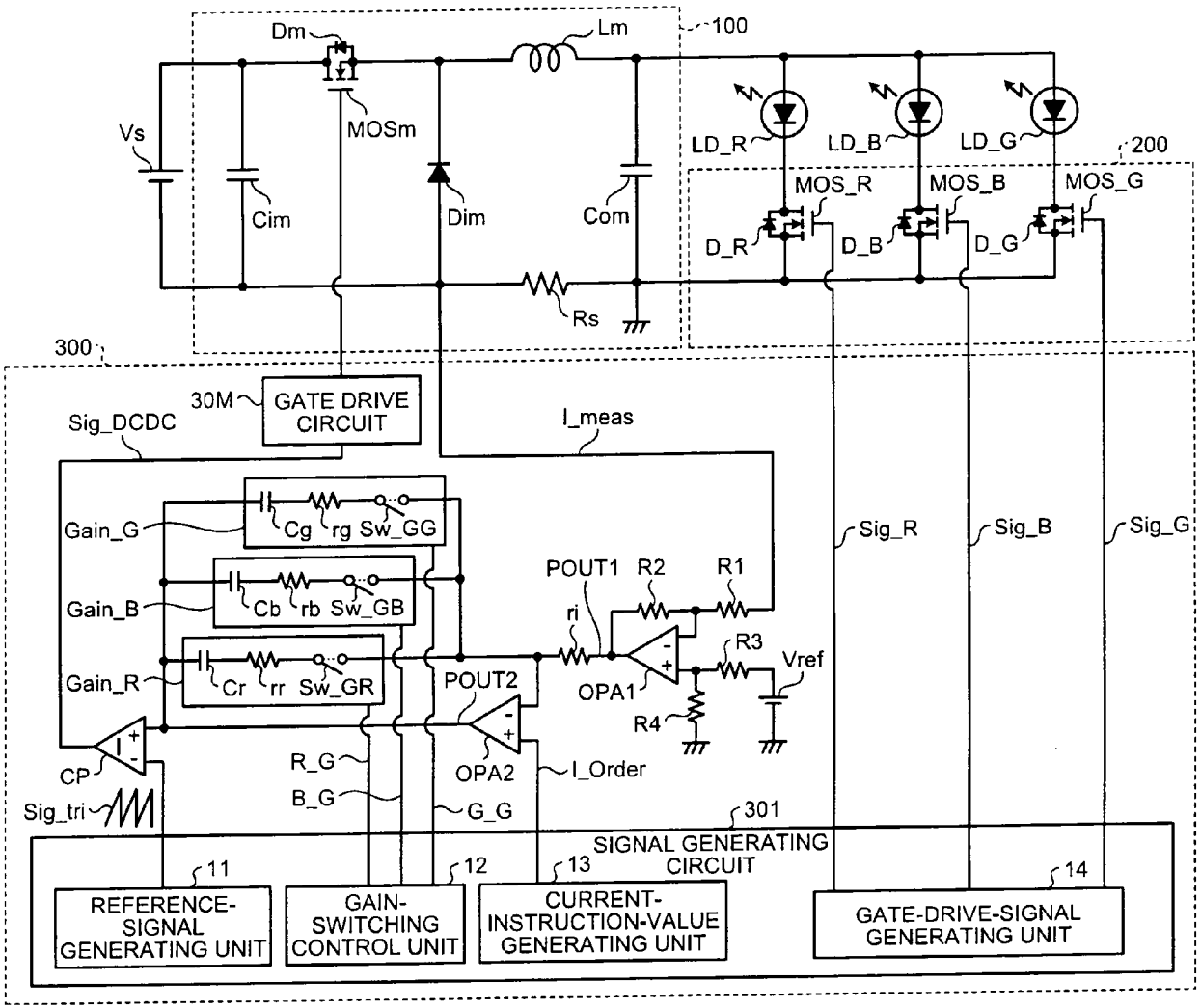
FIG. 1 is a block diagram of a schematic configuration of a display unit to which a drive device for a light-emitting element according to a first embodiment of the present invention is applied.

FIG. 1 is a block diagram of a schematic configuration of a display unit to which a drive device for a light-emitting element according to a first embodiment of the present invention is applied. The drive device for the light-emitting element includes a direct current-to-direct current (DC-DC) converting unit 100 being a power converting unit that supplies predetermined currents to the light-emitting elements LD_R, LD_B, and LD_G that are connected in parallel with each other. The drive device also includes a light-emitting-element selection circuit 200 being a light-emitting-element selecting unit that sequentially selects one of the light-emitting elements LD_R, LD_B, and LD_G to which a current is supplied from the DC-DC converting unit 100, and a control circuit 300 that controls currents which flow into the light-emitting elements LD_R, LD_B, and LD_G.

The light-emitting element LD_R can emit red (R) light, the light-emitting element LD_B can emit blue (B) light, and the light-emitting element LD_G can emit green (G) light. Rated currents required for the light-emitting elements LD_R, LD_B, and LD_G that emit the lights at predetermined luminance may be different from each other. Furthermore, a laser diode (LD) or a light-emitting diode (LED) can be used as the light-emitting elements LD_R, LD_B, and LD_G.

It is noted that emission colors of the light-emitting elements LD_R, LD_B, and LD_G are not always limited to red, blue, and green. Therefore, the emission colors may include any color other than the colors or may be any other combination. Further, the number of light-emitting elements LD_R, LD_B, and LD_G is not necessarily limited to three, and thus, any number of light-emitting elements may be provided if there is a plurality of light-emitting elements. As shown in FIG. 1, when three light-emitting elements are provided, one frame is time-shared into three, and lights of red, blue, and green colors are sequentially emitted, to form an image.

As the DC-DC converting unit 100, a non-insulated step-down DC-DC converting unit may be used, or a non-insulated step-up DC-DC converting unit, an insulated forward DC-DC converting unit, or a flyback-type DC-DC converting unit using a transformer may be used.

The DC-DC converting unit 100 includes a field-effect transistor MOSm that intermittently conducts a direct-current voltage. The field-effect transistor MOSm includes a parasitic diode connected in an inverse-parallel manner, which is represented as a diode Dm. A drain of the field-effect transistor MOSm is grounded sequentially through a capacitor Cim and a resistor Rs, with a source grounded sequentially through a coil Lm and a capacitor Com. A cathode terminal of a diode Dim is connected to the source of the field-effect transistor MOSm, while an anode terminal of the diode Dim is connected to a node between the capacitor Cim and the resistor Rs. A direct-current power supply Vs is connected in parallel with the capacitor Cim, and a node between the coil Lm and the capacitor Com is connected to anode terminals of the light-emitting elements LD_R, LD_B, and LD_G.

The light-emitting-element selection circuit 200 includes field-effect transistors MOS_R, MOS_B, and MOS_G that conduct currents flowing into the light-emitting elements LD_R, LD_B, and LD_G, respectively. The light-emitting elements LD_R, LD_B, and LD_G include parasitic diodes connected in inverse-parallel thereto, which are represented as diodes D_R, D_B, and D_G shown in FIG. 1, respectively. Drains of the field-effect transistors MOS_R, MOS_B, and MOS_G are connected to cathode terminals of the light-emitting elements LD_R, LD_B, and LD_G respectively, and sources of the field-effect transistors MOS_R, MOS_B, and MOS_G are grounded.

The control circuit 300 includes gain selection circuits Gain_R, Gain_B, and Gain_G which are gain selecting units, operational amplifiers OPA1 and OPA2, a comparator CP, a gate drive circuit 30M, and a signal generating circuit 301.

The gain selection circuits Gain_R, Gain_B, and Gain_G are provided for the light-emitting elements LD_R, LD_B, and LD_G, respectively, so that a gain of the operational amplifier OPA2 can be selected for each of the light-emitting elements LD_R, LD_B, and LD_G. The operational amplifier OPA1 can convert an output current of the DC-DC converting unit 100 to a voltage. The operational amplifier OPA2 can multiply a difference between the output current of the DC-DC converting unit 100 and a target current by the gain and output an obtained value. The target current mentioned here indicates a current required for the light-emitting element to emit light at desired brightness. The comparator CP can output a pulse signal whose duty ratio changes according to an output of the operational amplifier OPA2. The gate drive circuit 30M can generate a gate drive signal for driving the field-effect transistor MOSm. The signal generating circuit 301 can generate various control signals for controlling the light-emitting-element selection circuit 200 ands the control circuit 300.

Moreover, the gain selection circuits Gain_R, Gain_B, and Gain_G include capacitors Cr, Cb, and Cg; resistors rr, rb, and rg; and switching elements Sw_GR, Sw_GB, and Sw_GG, respectively. The capacitors Cr, Cb, and Cg; the resistors rr, rb, and rg; and the switching elements Sw_GR, Sw_GB, and Sw_GG are connected in series respectively. It is noted that bi-directional switches each formed of a semiconductor device can be used as the switching elements Sw_GR, Sw_GB, and Sw_GG.

The signal generating circuit 301 includes a reference-signal generating unit 11, a gain-switching control unit 12, and a current-instruction-value generating unit 13, and a gate-drive-signal generating unit 14. The gate-drive-signal generating unit 14 can generate gate drive signals Sig_R, Sig_B, and Sig_G for turning ON/OFF the field-effect transistors MOS_R, MOS_B, and MOS_G, respectively. The reference-signal generating unit 11 can generate a reference signal Sig_tri used to be compared with an output level of the operational amplifier OPA2. A waveform of the reference signal Sig_tri can be, for example, a sawtooth waveform or a triangular waveform.

The gain-switching control unit 12 can generate switch signals R_G, B_G, and G_G for turning ON/OFF the switching elements Sw_GR, Sw_GB, and Sw_GG, respectively. The gain-switching control unit 12 can output the switch signals R_G, B_G, and G_G in synchronization with the gate drive signals Sig_R, Sig_B, and Sig_G, respectively, output from the gate-drive-signal generating unit 14. The current-instruction-value generating unit 13 can generate a current instruction value I_Order for providing a target current for the DC-DC converting unit 100.

An inverting input terminal of the operational amplifier OPA1 is connected to a node between the capacitor Cim and the resistor Rs through a resistor R1, and is connected to an output terminal of the operational amplifier OPA1 through a resistor R2. A non-inverting input terminal of the operational amplifier OPA1 is grounded through a resistor R4, and is connected to a reference supply Vref through a resistor R3. The output terminal of the operational amplifier OPA1 is connected to an inverting input terminal of the operational amplifier OPA2 through a resistor ri.

The inverting input terminal of the operational amplifier OPA2 is connected to an output terminal of the operational amplifier OPA2 through the gain selection circuits Gain_R, Gain_B, and Gain_G respectively and to a positive input terminal of the comparator CP. A non-inverting input terminal of the operational amplifier OPA2 is connected to the current-instruction-value generating unit 13.

A negative input terminal of the comparator CP is connected to the reference-signal generating unit 11. An output terminal of the comparator CP is connected to an input terminal of the gate drive circuit 30M, and an output terminal of the gate drive circuit 30M is connected to a gate of the field-effect transistor MOSm.

The gain-switching control unit 12 is connected individually to switch terminals of the switching elements Sw_GR, Sw_GB, and Sw_GG. The gate-drive-signal generating unit 14 is connected individually to the field-effect transistors MOS_R, MOS_B, and MOS_G.

A direct-current voltage generated in the direct-current power supply Vs is converted to a pulse voltage by an ON/OFF operation of the field-effect transistor MOSm. When the field-effect transistor MOSm is on, a current flows through a channel as follows: direct-current power supply Vs→field-effect transistor MOSm→coil Lm→capacitor Com→resistor Rs→direct-current power supply Vs. When the field-effect transistor MOSm is off, a current flows through a channel as follows: diode Dim→coil Lm→capacitor Com→resistor Rs→diode Dim. The pulse voltage output from the field-effect transistor MOSm is thereby converted to a direct-current voltage, which is generated in the capacitor Com as a direct-current voltage obtained by stepping down the direct-current voltage generated in the direct-current power supply Vs, and a controlled voltage is applied to the light-emitting elements LD_R, LD_B, and LD_G, respectively.

Applied to the gate of the field-effect transistor MOSm is a pulse voltage generated in the control circuit 300. By increasing or decreasing an on-duty ratio of the pulse voltage, the direct-current voltage generated in the capacitor Com increases or decreases, and each output current output from the DC-DC converting unit 100 to the light-emitting elements LD_R, LD_B, and LD_G is increased or decreased.

Details of the operation of the DC-DC converting unit 100 are described in "Power Electronics Circuit" compiled by the Institute of Electrical Engineers of Japan and the Semiconductor Power Conversion System Research Committee, published 2000 by Ohmsha Ltd., pp. 245-265.

The gate drive signals Sig_R, Sig_B, and Sig_G generated in the gate-drive-signal generating unit 14 are input to the gates of the field-effect transistors MOS_R, MOS_B, and MOS_G, respectively. By sequentially turning on and off the field-effect transistors MOS_R, MOS_B, and MOS_G, the light-emitting elements LD_R, LD_B, and LD_G into which each output current of the DC-DC converting unit 100 flows are sequentially selected.

The output current of the DC-DC converting unit 100 sequentially flows into the light-emitting elements LD_R, LD_B, and LD_G, and these elements thereby emit the R, B, and G lights in this order in a time-sharing manner.

Meanwhile, the output current of the DC-DC converting unit 100 is detected by the resistor Rs, and the detected current is converted to a voltage, thereby generating a current detection signal I_meas. It is noted that the current detection signal I_meas can be given by a following equation, where I is an output current of the DC-DC converting unit 100 and Rs is a value of the resistor Rs.

$$I_\text{meas}=-Rs\times I$$

The current detection signal I_meas obtained by converting the output current to the voltage by the resistor Rs is input to the inverting input terminal of the operational amplifier OPA1 through the resistor R1, a reference voltage generated in the reference supply Vref is input to the non-inverting input terminal of the operational amplifier OPA1 through the resistor R3, and an output from the operational amplifier OPA1 is input to the inverting input terminal of the operational amplifier OPA2 through the resistor ri. An output POUT1 of the operational amplifier OPA1 can be given by a following equation, where Vref is a reference voltage generated in the reference supply Vref, R1 to R4 are values of the resistors R1 to R4, and a relation of R1=R4 and R2=R3 is satisfied.

$$P\text{OUT1}=V\text{ref}-R2/R1\times I_\text{meas}$$

The current instruction value I_Order generated in the current-instruction-value generating unit 13 is input to the non-inverting input terminal of the operational amplifier OPA2. It is noted that the current instruction value I_Order is given by a following equation, where Is indicates a target current.

$$I_\text{Order}=V\text{ref}+R2/R1\times Rs\times Is$$

Here, current instruction values I_Order can be set so that, for example, when the light-emitting element LD_R is selected, a current of 13 amperes flows, when the light-emitting element LD_B is selected, a current of 20 amperes flows, and when the light-emitting element LD_G is selected, a current of 30 amperes flows.

In the operational amplifier OPA2, a difference between the current instruction value I_Order and the output POUT1 of the operational amplifier OPA1 is amplified according to a gain provided by any one of the gain selection circuits Gain_R, Gain_B, and Gain_G, and the difference is input to the positive input terminal of the comparator CP.

Gains provided by the gain selection circuits Gain_R, Gain_B, and Gain_G can be set for the light-emitting elements LD_R, LD_B, and LD_G respectively, and can be decided based on currents which flow into the light-emitting elements LD_R, LD_B, and LD_G and also based on characteristics thereof, respectively. Moreover, the gains provided by the gain selection circuits Gain_R, Gain_B, and Gain_G can be set so that responsivity and stability of an output current are improved when the output current is changed for each of the light-emitting elements LD_R, LD_B, and LD_G. For example, when a difference between currents is large upon switching of the light-emitting elements LD_R, LD_B, and LD_G through which the currents flow, it is possible to increase the gains provided by the gain selection circuits Gain_R, Gain_B, and Gain_G corresponding to the light-emitting elements LD_R, LD_B, and LD_G, respectively, each of which is switched so that a predetermined current flows more quickly.

The switch signals R_G, B_G, and G_G generated in the gain-switching control unit 12 are input to the switch terminals of the switching elements Sw_GR, Sw_GB, and Sw_GG respectively, a gain of the operational amplifier OPA2 is provided by any one of the gain selection circuits Gain_R, Gain_B, and Gain_G, and a difference between the current instruction value I_Order and the output POUT1 from the operational amplifier OPA1 is amplified according to the gain provided by one of the gain selection circuits Gain_R, Gain_B, and Gain_G.

The reference signal Sig_tri generated by the reference-signal generating unit 11 is input to the negative input terminal of the comparator CP.

The comparator CP compares the reference signal Sig_tri with an output POUT2 from the operational amplifier OPA2, and outputs a pulse signal Sig_DCDC, whose duty ratio changes according to an output level from the operational amplifier OPA2, to the gate drive circuit 30M.

The gate drive circuit 30M converts the pulse signal Sig_DCDC output from the comparator CP to a gate drive signal based on a potential, as a reference, at the source of the field-effect transistor MOSm, and outputs the gate drive signal to the gate of the field-effect transistor MOSm.

The gate of the field-effect transistor MOSm is driven by the gate drive signal output from the gate drive circuit 30M, and an ON/OFF duty ratio of the field-effect transistor MOSm thereby changes, so that respective currents which flow into the light-emitting elements LD_R, LD_B, and LD_G are controlled so as to approach each target current instructed by the current instruction values I_Order.

Each gain of the operational amplifier OPA2 is set for each of the light-emitting elements LD_R, LD_B, and LD_G in the gain selection circuits Gain_R, Gain_B, and Gain_G. The gain selection circuits Gain_R, Gain_B, and Gain_G are then caused to operate according to a selection of each of the light-emitting elements LD_R, LD_B, and LD_G. The operation thereby allows improvement of the responsivity and stability of the output current of the DC-DC converting unit 100 even when the flowing current changes in each of the light-emitting elements LD_R, LD_B, and LD_G. Thus, the output current can be stabilized at a fast response speed according to the change in each status of the light-emitting elements LD_R, LD_B, and LD_G without using auxiliary capacitors for supplying energy to the light-emitting elements LD_R, LD_B, and LD_G.

FIG. 2 is a diagram of ON/OFF periods of the field-effect transistors MOS_R, MOS_B, and MOS_G shown in FIG. 1. An output current of the DC-DC converting unit 100 sequentially flows through the light-emitting elements LD_R, LD_B, and LD_G, and this allows the light-emitting elements LD_R, LD_B, and LD_G to emit lights in this order in the time-sharing manner.

In a light emission period of the light-emitting element LD_R, a current instruction value I_Order is set so as to correspond to a target current of the light-emitting element LD_R, the field-effect transistor MOS_R is turned on, and a current is thereby supplied from the DC-DC converting unit 100 to the light-emitting element LD_R. A gain provided by the gain selection circuit Gain_R is set in the operational amplifier OPA2 in response to turning-on of the switching element Sw_GR when the current is to be supplied to the light-emitting element LD_R.

In a light emission period of the light-emitting element LD_B, a current instruction value I_Order is set so as to correspond to a target current of the light-emitting element LD_B, the field-effect transistor MOS_B is turned on, and a current is thereby supplied from the DC-DC converting unit 100 to the light-emitting element LD_B. A gain provided by the gain selection circuit Gain_B is set in the operational amplifier OPA2 in response to turning-on of the switching element Sw_GB when the current is to be supplied to the light-emitting element LD_B.

In a light emission period of the light-emitting element LD_G, a current instruction value I_Order is set so as to correspond to a target current of the light-emitting element LD_G, the field-effect transistor MOS_G is turned on, and a current is thereby supplied from the DC-DC converting unit 100 to the light-emitting element LD_G. A gain provided by the gain selection circuit Gain_G is set in the operational amplifier OPA2 in response to turning-on of the switching element Sw_GG when the current is to be supplied to the light-emitting element LD_G.

Figure 3:
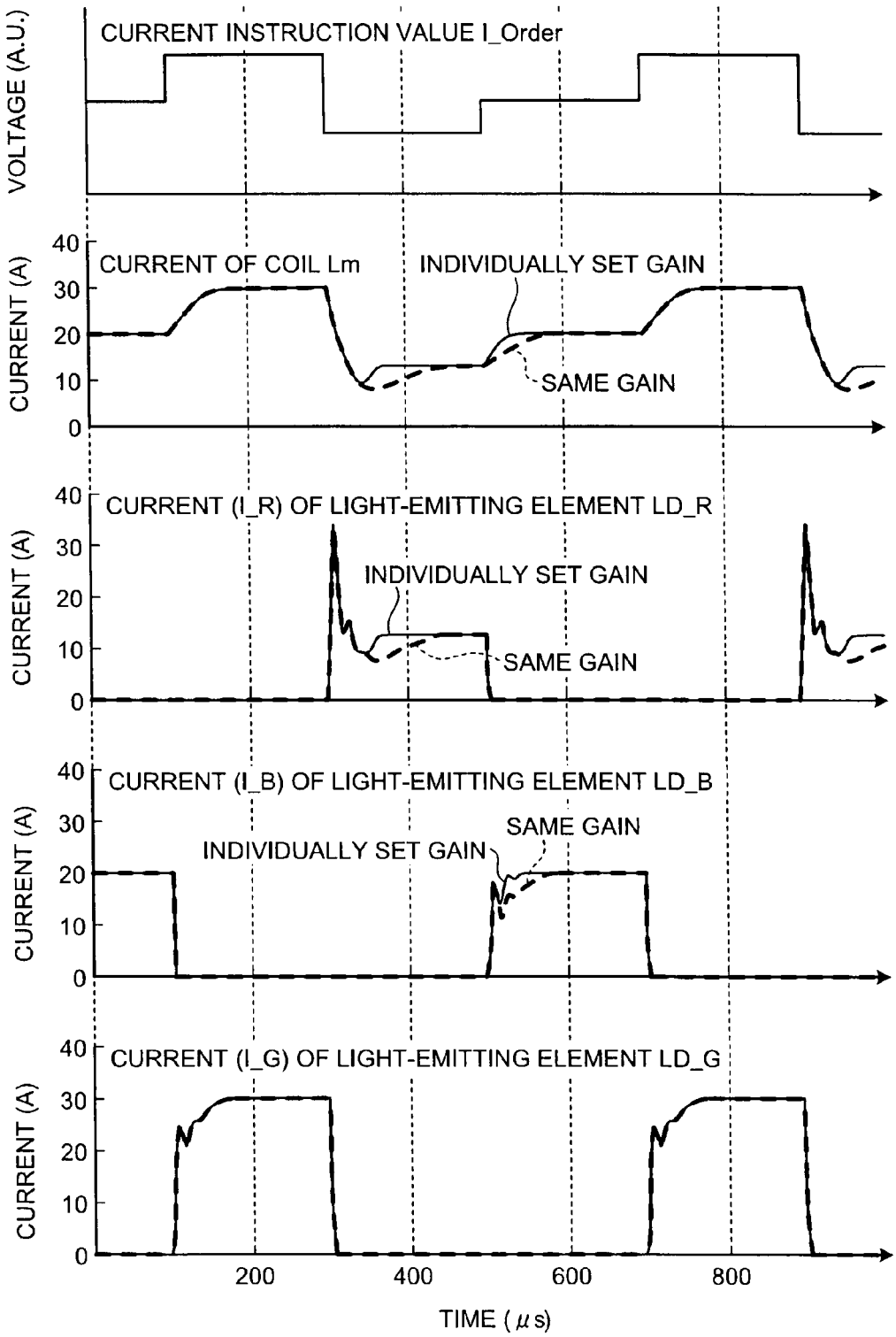
FIG. 3 is a diagram of waveforms for a current instruction value I_Order, a current of a coil Lm, and currents of light-emitting elements LD_R, LD_B, and LD_G in the drive device shown in FIG. 1.

FIG. 3 is a diagram of waveforms for a current instruction value I_Order, a current of the coil Lm, and currents of the light-emitting elements LD_R, LD_B, and LD_G in the drive device shown in FIG. 1 in comparison of a case where a gain is individually set for each of the light-emitting elements LD_R, LD_B, and LD_G with a case where the same gain is set for the light-emitting elements LD_R, LD_B, and LD_G. The current of the coil Lm can be made equivalent to the output current of the DC-DC converting unit 100. Here, following current conditions were set as the target currents of the light-emitting elements LD_R, LD_B, and LD_G. That is, 13 amperes was set for the light-emitting element LD_R, 20 amperes for the light-emitting element LD_B, and 30 amperes for the light-emitting element LD_G, and each light emission period of the light-emitting elements LD_R, LD_B, and LD_G was set to 200 microseconds with a period of 600 microseconds. Further, when the same gain was set for the light-emitting elements LD_R, LD_B, and LD_G, the set gain is a value equal to the gain set for the light-emitting element LD_G as one of the gains which were set individually for the light-emitting elements LD_R, LD_B, and LD_G.

In FIG. 3, by individually set the gain for each of the light-emitting elements LD_R, LD_B, and LD_G, it is possible to reduce undershoot of each waveform of currents I_R, I_B, and I_G flowing through the light-emitting elements LD_R, LD_B, and LD_G, respectively, and to flow responsive and stable currents I_R, I_B, and I_G through the light-emitting elements LD_R, LD_B, and LD_G, respectively.

Figure 4:
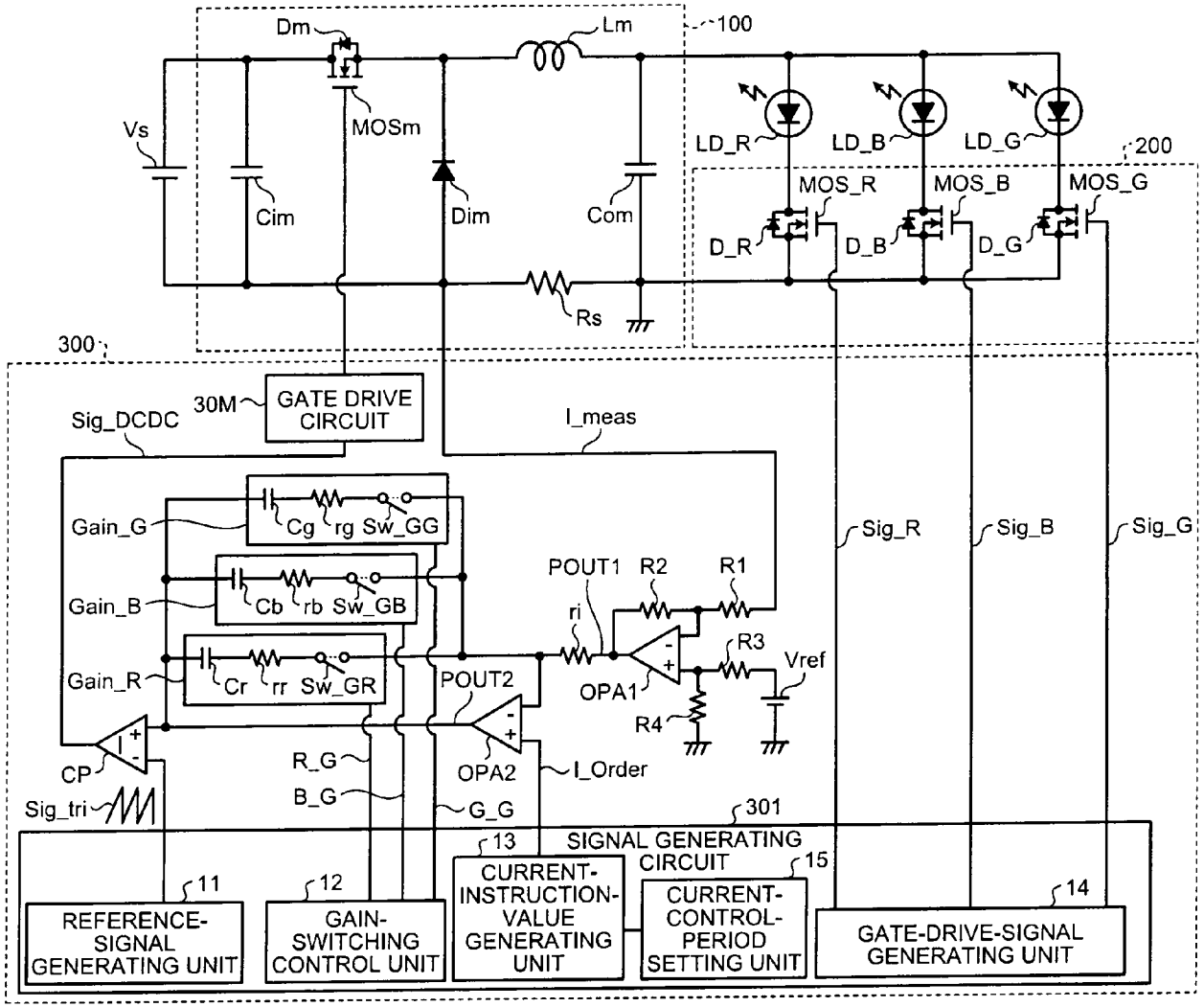
FIG. 4 is a block diagram of a schematic configuration of a display unit to which a drive device for a light-emitting element according to a second embodiment of the present invention is applied.

FIG. 4 is a block diagram of a schematic configuration of a display unit to which a drive device for a light-emitting element according to a second embodiment of the present invention is applied. In FIG. 4, a current-control-period setting unit 15 is provided in addition to the configuration of the drive device for the light-emitting elements in FIG. 1.

Similarly to the first embodiment, when the current flowing from the light-emitting element LD_G to the light-emitting element LD_R is switched, the current flowing through the light-emitting element LD_R becomes smaller than the current flowing through the light-emitting element LD_G, and because high energy stored in the coil Lm has nowhere to go, the energy is supplied to the light-emitting element LD_R. Because of this, a larger current than the target value temporarily flows into the light-emitting element LD_R immediately after the current flowing from the light-emitting element LD_G to the light-emitting element LD_R is switched.

In FIG. 4, when a current supplied to a currently selected one of the light-emitting elements LD_R, LD_B, and LD_G is larger than a current supplied to a next selected one of the light-emitting elements LD_R, LD_B, and LD_G, the current-control-period setting unit 15 can set a current control period in which the current flowing through the currently selected one is reduced before the current is supplied to the next selected one. When the current flowing through the currently selected one is reduced, the value of the current after being reduced can be set to a value of a target current of the next selected one.

In this case, it is preferable that the light-emitting-element selection circuit 200 sequentially switches from the light-emitting elements LD_R, LD_B, and LD_G with a small current to the light-emitting elements LD_R, LD_B, and LD_G with a large current in one period in which the light-emitting elements LD_R, LD_B, and LD_G are sequentially selected one time each. For example, when the target current of the light-emitting element LD_R is 13 amperes, the target current of the light-emitting element LD_B is 20 amperes, and the target current of the light-emitting element LD_G is 30 amperes, the light-emitting elements LD_R, LD_B, and LD_G can be switched in the following order: light-emitting element LD_R→light-emitting element LD_B→light-emitting element LD_G.

When a current control period is set by the current-control-period setting unit 15, current instruction values I_Order generated by the current-instruction-value generating unit 13 can be set in the following manner. For example, when the light-emitting element LD_R is selected, a current of 13 amperes flows, and when the light-emitting element LD_B is selected, a current of 20 amperes flows. When the light-emitting element LD_G is selected, a current of 30 amperes flows, and then a current of 13 amperes flows in the current control period immediately before the light-emitting element LD_G is switched to the light-emitting element LD_R.

The current instruction value I_Order generated by the current-instruction-value generating unit 13 is input to the non-inverting input terminal of the operational amplifier OPA2. A difference between the current instruction value I_Order and the output POUT1 from the operational amplifier OPA2 is amplified according to a gain provided by any one of the gain selection circuits Gain_R, Gain_B, and Gain_G, and the difference is input to the positive input terminal of the comparator CP.

The comparator CP compares the output POUT2 from the operational amplifier OPA2 with the reference signal Sig_tri, and generates the pulse signal Sig_DCDC whose duty ratio changes according to an output level from the operational amplifier OPA2.

The gate of the field-effect transistor MOSm is driven based on the pulse signal Sig_DCDC generated by the comparator CP, and an ON/OFF duty ratio of the field-effect transistor MOSm thereby changes. Each current flowing through the light-emitting elements LD_R, LD_B, and LD_G is controlled so as to approach each target current of the light-emitting elements LD_R, LD_B, and LD_G instructed by the current instruction values I_Order, and in the current control period, the current flowing through the light-emitting element LD_G is also controlled so as to approach the target current of the light-emitting element LD_R.

FIG. 5 is a diagram of ON/OFF periods and a current control period of the field-effect transistors MOS_R, MOS_B, and MOS_G shown in FIG. 4. An output current of the DC-DC converting unit 100 sequentially flows into the light-emitting elements LD_R, LD_B, and LD_G, and this allows the light-emitting elements LD_R, LD_B, and LD_G to emit lights in this order in the time-sharing manner.

In a light emission period of the light-emitting element LD_R, the field-effect transistor MOS_R is turned on, a current instruction value I_Order is set so as to correspond to the target current of the light-emitting element LD_R, and then a gain provided by the gain selection circuit Gain_R is set in the operational amplifier OPA2 in response to turning-on of the switching element Sw_GR.

In a light emission period of the light-emitting element LD_B, the field-effect transistor MOS_B is turned on, a current instruction value I_Order is set so as to correspond to the target current of the light-emitting element LD_B, and then a gain provided by the gain selection circuit Gain_B is set in the operational amplifier OPA2 in response to turning-on of the switching element Sw_GB.

In a light emission period of the light-emitting element LD_G, the field-effect transistor MOS_G is turned on, a current instruction value I_Order is set so as to correspond to the target current of the light-emitting element LD_G, and then a gain provided by the gain selection circuit Gain_G is set in the operational amplifier OPA2 in response to turning-on of the switching element Sw_GG.

In the current control period, the field-effect transistor MOS_G is turned on, a current instruction value I_Order is set so as to correspond to the target current of the light-emitting element LD_R, and then the gain provided by the gain selection circuit Gain_G is set in the operational amplifier OPA2 in response to turning-on of the switching element Sw_GG. The example of FIG. 5 explains the method of setting the gain provided by the gain selection circuit Gain_G in the operational amplifier OPA2 in the current control period. However, when the current control period is provided, another gain selection circuit that sets a gain specific to the current control period may be provided separately from the gain selection circuits Gain_R, Gain_B, and Gain_G.

Figure 6:
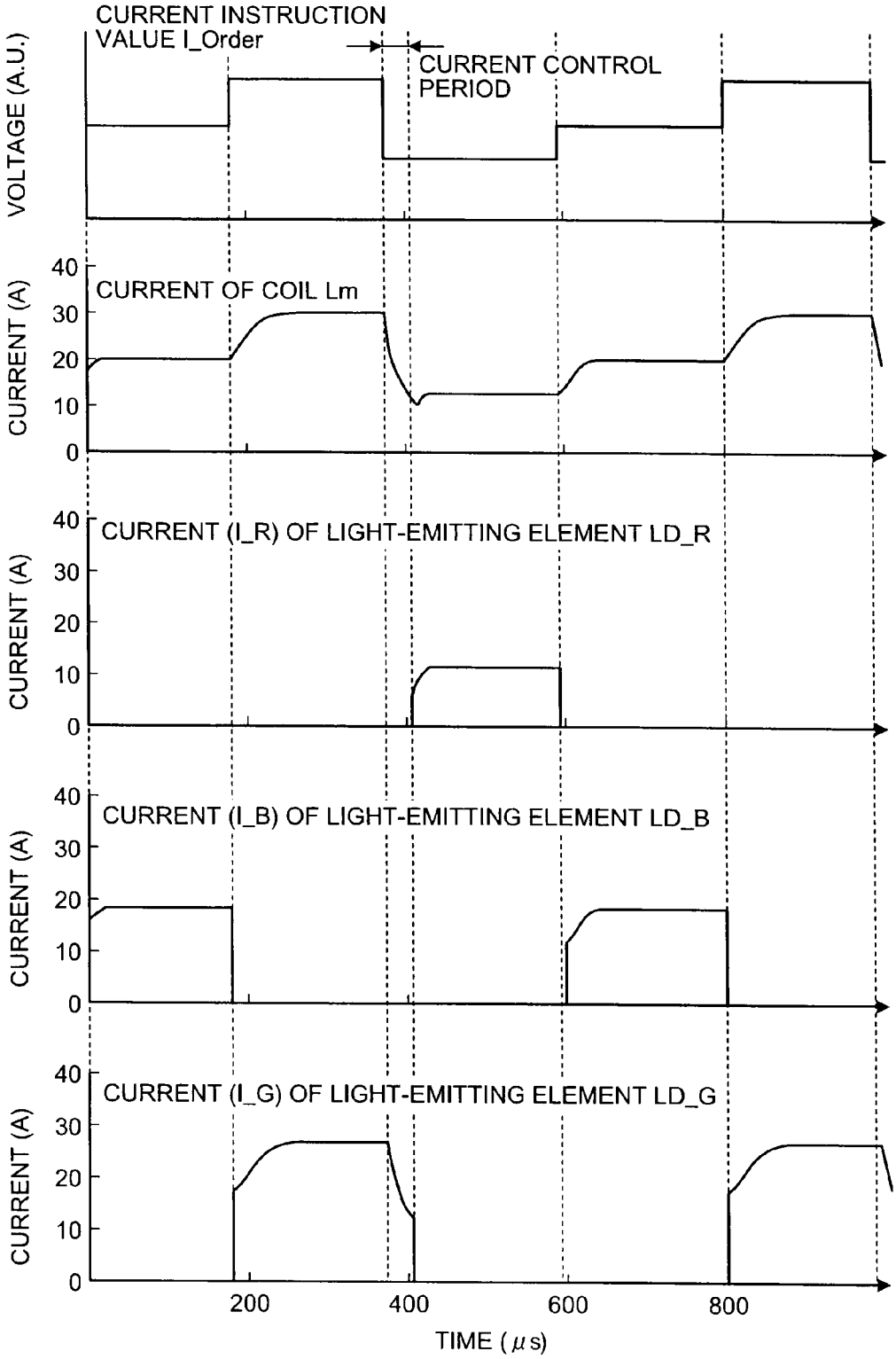
FIG. 6 is a diagram of waveforms for a current instruction value I_Order, a current of a coil Lm, and currents of light-emitting elements LD_R, LD_B, and LD_G in the drive device shown in FIG. 4.

FIG. 6 is a diagram of waveforms for a current instruction value I_Order, a current of the coil Lm, and currents of the light-emitting elements LD_R, LD_B, and LD_G in the drive device shown in FIG. 4. As current conditions, 13 amperes was set for the light-emitting element LD_R, 20 amperes for the light-emitting element LD_B, and 30 amperes for the light-emitting element LD_G; each light emission period of the light-emitting elements LD_R, LD_B, and LD_G was set to 200 microseconds with a period of 625 microseconds; and the current control period was set to 25 microseconds.

In FIG. 6, by individually set the gain for each of the light-emitting elements LD_R, LD_B, and LD_G, it is possible to reduce undershoot of each waveform of the currents I_R, I_B, and I_G flowing through the light-emitting elements LD_R, LD_B, and LD_G, respectively, and to flow responsive and stable currents I_R, I_B, and I_G through the light-emitting elements LD_R, LD_B, and LD_G, respectively.

By providing the current control period, the value of the current that flows into the light-emitting element LD_R can be made to approach the value of the current that flows through the light-emitting element LD_G immediately before the current flowing from the light-emitting element LD_G to the light-emitting element LD_R is switched. A current larger than the target current can thereby be prevented from temporarily flowing through the light-emitting element LD_R immediately after switching of the current flowing from the light-emitting element LD_G to the light-emitting element LD_R. Thus, the light-emitting element LD_R can be prevented from being damaged due to an overcurrent.

Moreover, by switching the current flowing into the light-emitting elements LD_R, LD_B, and LD_G in the following order: light-emitting element LD_R→light-emitting element LD_B→light-emitting element LD_G, the number of times in which the current changes from a large value to a small value can be set to only one time in one period in which the light-emitting elements LD_R, LD_B, and LD_G are sequentially selected one time each. Thus, the current control period is simply provided only once, which can prevent the current control period from being prolonged.

The second embodiment explains the method of individually setting each gain for each of the light-emitting elements LD_R, LD_B, and LD_G and providing the current control period. However, when the period in which light emission is repeated is comparatively long, a ratio between each light emission period of the light-emitting elements LD_R, LD_B, and LD_G and a time in which a current is stable increases. Thus, a transitional time required until the current is stabilized is negligible. Accordingly, an effect that responsivity of the output current from the DC-DC converting unit 100 is exerted on image quality of the display unit using the light-emitting elements LD_R, LD_B, and LD_G becomes negligible. Therefore, the current control period may be provided without individually setting each gain for each of the light-emitting elements LD_R, LD_B, and LD_G.

Figure 7:
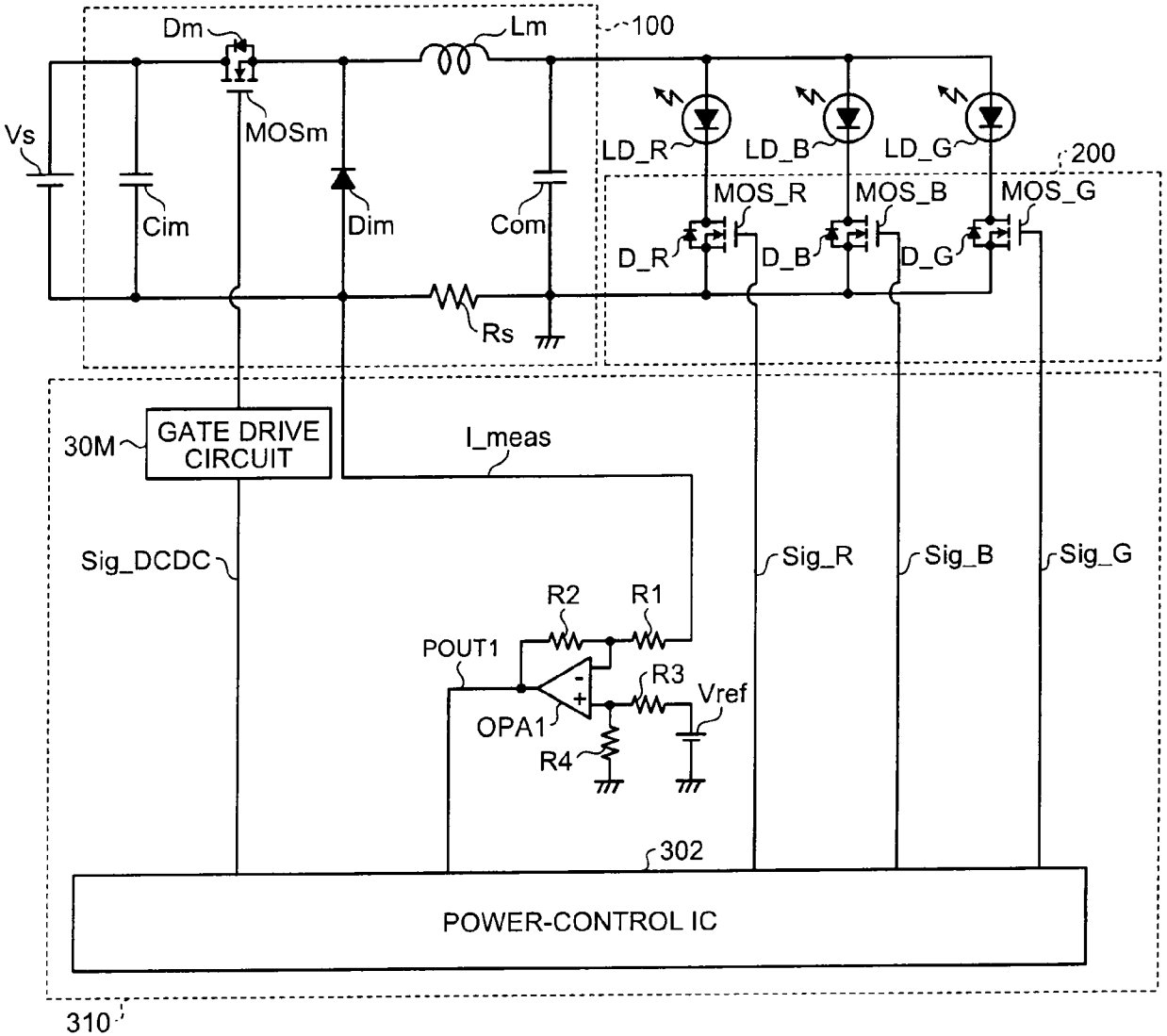
FIG. 7 is a block diagram of a schematic configuration of a display unit to which a drive device for a light-emitting element according to a third embodiment of the present invention is applied.

FIG. 7 is a block diagram of a schematic configuration of a display unit to which a drive device for a light-emitting element according to a third embodiment of the present invention is applied. The drive device for the light-emitting element is provided with a control circuit 310 instead of the control circuit 300 in FIG. 1. The control circuit 310 includes the operational amplifier OPA1, the resistors R1 to R4, the reference supply Vref, the gate drive circuit 30M, and a power-control integrated circuit (IC) 302.

The power-control IC 302 includes a microcomputer, an analog-to-digital (A-D) converting unit, and a comparator. The power-control IC 302 can implement functions of the gain selection circuits Gain_R, Gain_B, and Gain_G, the operational amplifier OPA2, the comparator CP, and the signal generating circuit 301 in FIG. 1, and can cause the microcomputer to change each gain provided by the gain selection circuits Gain_R, Gain_B, and Gain_G.

The gate drive signals Sig_R, Sig_B, and Sig_G are generated by the power-control IC 302, and are input to the gates of the field-effect transistors MOS_R, MOS_B, and MOS_G, respectively, so that the light-emitting elements D_R, LD_B, and LD_G into which an output current of the DC-DC converting unit 100 flows are sequentially selected.

Meanwhile, the current detection signal I_meas output from the DC-DC converting unit 100 is input to the inverting input terminal of the operational amplifier OPA1 through the resistor R1, and the output POUT1 of the operational amplifier OPA1 is input to the power-control IC 302.

When receiving the output POUT1 from the operational amplifier OPA1, the power-control IC 302 generates a value by multiplying a difference between the current instruction value I_Order and the output POUT1 of the operational amplifier OPA1 by each gain individually set for the light-emitting elements LD_R, LD_B, and LD_G. The power-control IC 302 then generates a pulse signal Sig_DCDC whose duty ratio changes according to the generated value, and outputs the signal to the gate drive circuit 30M.

The gate of the field-effect transistor MOSm is driven based on the pulse signal Sig_DCDC generated by the power-control IC 302, and an ON/OFF duty ratio of the field-effect transistor MOSm thereby changes, so that each current which flows into the light-emitting elements LD_R, LD_B, and LD_G is controlled so as to approach each target current of the light-emitting elements LD_R, LD_B, and LD_G instructed by the current instruction values I_Order.

The power-control IC 302 implements selection of the light-emitting elements LD_R, LD_B, and LD_G, switching of a gain for each of the light-emitting elements LD_R, LD_B, and LD_G, and formation of a pulse-width modulation (PWM) voltage signal of which duty ratio is set according to a level of the current detection signal I_meas, and the implementation allows reduction in the circuit scale and minimization of the control circuit 310.

According to one aspect of the present invention, the output current can be stabilized at a fast response speed corresponding to a change in each status of the light-emitting elements without using the auxiliary capacitors that supply energy to the light-emitting elements.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A device for driving at least two light-emitting elements with different currents required for obtaining predetermined emission intensities, the device comprising:

a power converting unit that supplies a predetermined current to each of the light-emitting elements by controlling a duty ratio of a semiconductor switching element that intermittently conducts a direct-current voltage;

a light-emitting-element selecting unit that sequentially selects a light-emitting element to be supplied with the current from the power converting unit;

a duty-ratio control unit that controls the duty ratio of the semiconductor switching element based on a value obtained by multiplying a gain by a difference between an output current of the power converting unit and a target current; and a gain selecting unit that changes the gain according to selected light-emitting element.

2. The device according to claim 1, wherein the gain selecting unit is configured with series circuits of a resistor, a capacitor, and a switching element provided for each light emission color, the series circuits being connected in parallel to each other, and the device further comprises a gain-switching control unit that changes the gain by turning on the switching element according to the selected light-emitting element.

3. The device according to claim 1, wherein the gain selecting unit is incorporated in a microcomputer.

4. The device according to claim 1, further comprising a current-control-period setting unit that sets a current control period in which a current flowing through the light-emitting element is reduced, wherein when a current supplied to a currently selected light-emitting element is larger than a current to be supplied to a next selected light-emitting element, the current-control-period setting unit sets the current control period for the currently selected light-emitting element before supplying the current to the next selected light-emitting element.

5. The device according to claim 4, wherein the light-emitting-element selecting unit sequentially switches from a light-emitting element with a smaller current to a light-emitting element with a larger current in a period in which the light-emitting elements with different light emission colors are sequentially selected one time each.

6. A device for driving at least two light-emitting elements with different currents required for obtaining predetermined emission intensities, the device comprising:

a power converting unit that supplies a predetermined current to each of the light-emitting elements by controlling a duty ratio of a semiconductor switching element that intermittently conducts a direct-current voltage;

a light-emitting-element selecting unit that sequentially selects a light-emitting element to be supplied with the current from the power converting unit; and a current-control-period setting unit that sets a current control period in which a current flowing through the light-emitting element is reduced, wherein when a current supplied to a currently selected light-emitting element is larger than a current to be supplied to a next selected light-emitting element, the current-control-period setting unit sets the current control period for the currently selected light-emitting element before supplying the current to the next selected light-emitting element.

7. The device according to claim 6, wherein the light-emitting-element selecting unit sequentially switches from a light-emitting element with a smaller current to a light-emitting element with a larger current in a period in which the light-emitting elements with different light emission colors are sequentially selected one time each.

* * * * *